US011098450B2

(12) United States Patent
Awofeso et al.

(10) Patent No.: US 11,098,450 B2
(45) Date of Patent: Aug. 24, 2021

(54) METHODS FOR MAKING IMPROVED CELLULOSIC PRODUCTS USING NOVEL PRESS FELTS AND PRODUCTS MADE THEREFROM

(71) Applicant: Albany International Corp., Rochester, NH (US)

(72) Inventors: Anthony O. Awofeso, Appleton, WI (US); James Bell, Wynantskill, NY (US); Clemens Stortelder, Lichtenvoorde (NL); Timothy Lamers, Combined Locks, WI (US); Thomas Biever, Kaukauna, WI (US)

(73) Assignee: Albany International Corp., Rochester, NH (US)

( * ) Notice: Subject to any disclaimer, the term of this patent is extended or adjusted under 35 U.S.C. 154(b) by 81 days.

(21) Appl. No.: 16/129,371

(22) Filed: Sep. 12, 2018

(65) Prior Publication Data

US 2019/0127914 A1 May 2, 2019

Related U.S. Application Data

(60) Provisional application No. 62/577,985, filed on Oct. 27, 2017.

(51) Int. Cl.
*D21F 7/08* (2006.01)
*D21F 11/00* (2006.01)
(Continued)

(52) U.S. Cl.
CPC ..... *D21F 11/008* (2013.01); *D21F 7/083* (2013.01); *D21F 11/006* (2013.01); *D21F 11/14* (2013.01);
(Continued)

(58) Field of Classification Search
CPC . D21F 7/08; D21F 7/083; D21F 7/086; D21F 7/10; D21F 7/12; D21F 1/10;
(Continued)

(56) References Cited

U.S. PATENT DOCUMENTS 3,059,312 A 10/1962 Jamieson
3,323,226 A 6/1967 Beaumont et al.
(Continued)

FOREIGN PATENT DOCUMENTS

EP 1 041 195 10/2000
EP 1 396 574 3/2004
(Continued)

OTHER PUBLICATIONS

Partial International Search Report dated Jan. 2, 2019 in related Application No. PCT/IB2018/058101.
(Continued)

*Primary Examiner* — Eric Hug
(74) *Attorney, Agent, or Firm* — McCarter & English, LLP

(57) ABSTRACT

The present application discloses improved cellulosic products and methods of making improved cellulosic products using split base core wet press felt designs having at least a first woven base core material and a second woven base core material, wherein the first and second base core materials are separated by at least one fibrous batting material. The present application further discloses improved cellulosic products and methods of making improved cellulosic products using press felts designs having an apertured polymeric sheet-side surface.

22 Claims, 16 Drawing Sheets

(51) Int. Cl.
*D21H 27/00* (2006.01)
*D21F 11/14* (2006.01)
*B31F 1/12* (2006.01)

(52) U.S. Cl.
CPC ..... *D21F 11/145* (2013.01); *D21H 27/002* (2013.01); *D21H 27/005* (2013.01); *B31F 1/126* (2013.01)

(58) Field of Classification Search
CPC ..... D21F 1/12; D21F 1/0027; D21F 1/0054; B32B 5/26
USPC ..... 162/348, 358.1, 358.2, 900, 902–904; 139/383 A, 383 AA, 425 A; 442/239, 442/240, 246, 255, 268, 270, 271
See application file for complete search history.

(56) References Cited

U.S. PATENT DOCUMENTS 3,399,111 A 8/1968 Beaumont et al.
3,613,258 A 10/1971 Jamieson
3,881,987 A 5/1975 Benz
4,206,258 A 6/1980 Balcar
4,315,048 A 2/1982 Beghelli et al.
4,427,734 A 1/1984 Johnson
4,533,437 A 8/1985 Curran et al.
4,541,895 A 9/1985 Albert
4,588,630 A 5/1986 Shimalla
4,737,241 A 4/1988 Gulya
4,752,519 A 6/1988 Boyer et al.
4,759,975 A 7/1988 Sutherland et al.
4,781,967 A 11/1988 Legge et al.
4,795,480 A 1/1989 Boyer et al.
4,798,760 A 1/1989 Diaz-Kotti
4,902,383 A 2/1990 Penven
4,988,409 A 1/1991 Nyberg
5,062,924 A 11/1991 McCarten et al.
5,071,697 A 12/1991 Gulya et al.
5,110,672 A 5/1992 Zehle et al.
5,134,010 A 7/1992 Schiel
5,144,729 A 9/1992 Austin et al.
5,151,314 A 9/1992 Brown
5,175,042 A 12/1992 Chomarat
5,254,398 A 10/1993 Gaisser
5,260,171 A 11/1993 Smurkoski et al.
5,268,076 A 12/1993 Best et al.
5,328,757 A 7/1994 Kenney et al.
5,372,876 A 12/1994 Johnson et al.
5,503,715 A 4/1996 Trokhan et al.
5,626,723 A 5/1997 Schiel et al.
5,693,187 A 12/1997 Ampulski et al.
5,700,356 A 12/1997 Lefkowitz
5,795,440 A 8/1998 Ampulski et al.
5,858,504 A 1/1999 Fitting
5,871,887 A 2/1999 Trokhan et al.
5,873,963 A 2/1999 Trombetta et al.
5,904,187 A 5/1999 Davenport
6,029,570 A 2/2000 Matuschczyk
6,077,397 A 6/2000 Shipley
6,140,260 A 10/2000 Johnson et al.
6,177,370 B1 1/2001 Skoog et al.
6,179,965 B1 1/2001 Cunnane, III et al.
6,193,847 B1 2/2001 Trokhan
6,194,331 B1 2/2001 Elkins
6,358,369 B1 3/2002 Yoshida et al.
6,395,957 B1 5/2002 Chen et al.
6,419,795 B1 7/2002 Dutt
6,420,625 B1 7/2002 Jones et al.
6,425,985 B1 7/2002 Hagfors et al.
6,436,240 B1 8/2002 Jeffrey
6,440,881 B1 * 8/2002 Ercken ..... B32B 7/12 442/320
6,511,582 B2 1/2003 Westerkamp
6,514,382 B1 2/2003 Kakiuchi et al.
6,514,386 B2 2/2003 Watanabe
6,531,033 B1 3/2003 Kawashima
6,565,713 B2 5/2003 Hansen et al.
6,569,290 B2 5/2003 Johnson
6,699,367 B2 3/2004 Gstrein et al.
6,699,368 B2 3/2004 Ishii et al.
6,716,318 B2 4/2004 Watanabe
6,773,553 B2 8/2004 Hyvönen et al.
6,776,878 B2 8/2004 Yook
6,797,121 B2 9/2004 Hyvönen et al.
6,872,283 B2 3/2005 Best
6,929,718 B2 8/2005 Kimura
6,979,387 B2 12/2005 Takeuchi et al.
6,998,023 B2 2/2006 Crook
7,005,042 B2 2/2006 Danzler
7,105,077 B2 * 9/2006 Onikubo ..... D21F 3/0227 162/358.2
7,118,650 B2 10/2006 Inoue
7,128,810 B2 10/2006 Hansen
7,144,479 B2 12/2006 Davis et al.
7,156,956 B2 1/2007 FitzPatrick
7,166,195 B2 1/2007 Hawes
7,192,895 B2 3/2007 Ito
7,207,355 B2 4/2007 Lee
7,265,067 B1 9/2007 Phan
7,306,704 B2 12/2007 Hyvönen
7,381,665 B2 6/2008 Onikubo et al.
7,384,517 B2 6/2008 Watanabe et al.
7,407,564 B2 8/2008 Hansen
7,442,426 B2 10/2008 Shimodaira et al.
7,455,752 B2 11/2008 Hansen
7,481,906 B2 1/2009 Ouchi et al.
7,550,061 B2 6/2009 Walkenhaus et al.
7,670,461 B2 3/2010 Westerkamp
7,674,732 B2 3/2010 Ito
7,799,175 B2 9/2010 Hansen
7,815,773 B2 10/2010 Herman et al.
7,842,166 B2 11/2010 Herman et al.
7,871,672 B2 1/2011 Crook et al.
7,993,493 B2 8/2011 Quigley
8,083,898 B2 12/2011 Best et al.
8,147,654 B2 * 4/2012 Sawada ..... D21F 7/086 162/358.2
8,152,964 B2 4/2012 Westerkamp et al.
8,282,782 B2 10/2012 Sawada et al.
8,366,878 B2 2/2013 Klerelid et al.
8,398,823 B2 3/2013 Mielke
8,449,723 B2 5/2013 Yamazaki
8,535,484 B2 9/2013 Hansen et al.
8,591,793 B2 11/2013 Weiss et al.
8,789,289 B2 7/2014 Herman et al.
8,961,742 B2 2/2015 Hédou et al.
9,315,940 B2 4/2016 Lee
2004/0094281 A1 5/2004 Hansen
2005/0167067 A1 8/2005 Crook et al.
2005/0181694 A1 8/2005 Crook et al.
2006/0062960 A1 3/2006 Morton
2006/0278361 A1 12/2006 Westerkamp
2007/0111625 A1 5/2007 Morton
2007/0277951 A1 12/2007 Westerkamp
2008/0176690 A1 7/2008 Lefkowitz
2008/0185115 A1 8/2008 Morton et al.
2010/0136286 A1 6/2010 Bez et al.
2010/0186913 A1 7/2010 Super et al.
2011/0100576 A1 5/2011 Ogiwara
2016/0038351 A1 2/2016 Cecchetto et al.

FOREIGN PATENT DOCUMENTS

EP 1 443 146 8/2004
EP 1 477 608 3/2007
EP 2 088 237 8/2009
EP 2 678 472 1/2014
FR 2 295 151 7/1976
JP H08-209578 8/1996
JP 2003/049381 2/2003
JP 4565625 10/2010
WO WO 86/005219 9/1986

(56) References Cited

FOREIGN PATENT DOCUMENTS

| | | |
|---|---|---|
| WO | WO 2004/094721 A1 | 11/2004 |
| WO | WO 2015/185278 | 12/2015 |
| WO | WO 2016/016077 | 2/2016 |

OTHER PUBLICATIONS

English-language Abstract of EP 1 396 574.
English-language Abstract of FR 2 295 151.
English-language Abstract of JP H08-209578.
English-language Abstract of JP 2003/049381.
English-language Abstract of WO 2015/185278.
English-language Abstract of WO 2016/016077.
Hakala et al., "Press Felts Coated with Electrospun Nanofibres," Fibres & Textiles in Eastern Europe, 2011, vol. 19, No. 1(84), pp. 89-93.CA.

* cited by examiner

Control Felt surfaces

Sheet Side Surface Roll Side Surface

Control Felt Cross Sections

CD Cross-Section MD Cross-Section

Exemplary Split Base Core Press Felt

Sheet Side Surface Roll Side Surface

Exemplary Split Base Core Press Felt Cross Sections

CD Cross-Section MD Cross-Section

Apertured Polymeric Surface Layer on the Sheet-Side of the Press Felt

Sheet Side Surface Roll Side Surface

Comparison of the Handsheet Bulk Attributes for Each Felt Design

Comparison of the Handsheet Strength Attributes for Each Felt Design

Control

METHODS FOR MAKING IMPROVED CELLULOSIC PRODUCTS USING NOVEL PRESS FELTS AND PRODUCTS MADE THEREFROM

RELATED APPLICATIONS

This application is based on U.S. Provisional Patent Application No. 62/577,985, filed Oct. 27, 2017, which is hereby incorporated by reference in its entirety.

TECHNICAL FIELD

The present application discloses methods of making improved cellulosic products using split base core wet press felt designs and improved cellulosic products resulting therefrom. The present application further discloses methods of making improved cellulosic products using press felts designs having an apertured polymeric sheet-side surface and improved cellulosic products resulting therefrom.

BACKGROUND

Wet press felts are known to be useful in the process of manufacturing cellulosic products, for example, paper, tissue, and towel products. Cellulosic products are conventionally manufactured by conveying an aqueous slurry of cellulosic fibers on a moving forming fabric along a papermaking machine. As the aqueous slurry is conveyed, water is drained and an embryonic cellulosic web begins to form.

Press felts may be used in the press section of the papermaking machine in order to facilitate withdrawal of additional water from the embryonic cellulosic web following formation. This process is also called dewatering. The dewatering process typically involves transporting the cellulosic web through a nip or series of nips, along with one or more press felts, in order to apply pressure in the nip and facilitate removal of water from the cellulosic web and transfer to and out of the press felt. This dewatering process causes the fibers in the cellulosic web to further adhere to one another and to form a cellulosic sheet for further processing in the dryer and other sections of the papermaking machine.

It is, therefore, desirable that the press felt be able to accept the water extracted from the wet cellulosic web in the press section. Relatedly, the press felt should be able to prevent the removed water from returning to the cellulosic web. The press felt must also be able to support and carry the cellulosic web through the dewatering process. Press felts may also participate in the finishing of the surface of the cellulosic sheet, creating smooth or textured surfaces.

There are a variety of press felt designs used in the art, and a particular press felt may be chosen based on its ability to impart desirable properties to the cellulosic sheet being manufactured. Traditional press felt designs comprise a single, unified woven base core material with a sheet-side fibrous batting material attached thereto. As used herein, the term sheet-side refers to the side of the press felt that is adjacent to the cellulosic web during dewatering. Conversely, the term roll-side refers to the side of the press felt that is adjacent to the press roll during dewatering. In some traditional press felt designs, the base core material may be surrounded by fibrous batting on both the sheet-side and the roll-side of the press felt.

Different press felt designs have been studied with the goal of increasing the caliper or bulk of the resulting cellulosic sheet. Sheets with increased caliper or bulk exhibit a number of benefits, including (a) a reduction in basis weight (meaning less fiber usage to save cost), (b) bigger roll diameter with the same amount of fiber material, (c) the ability to apply additional calendering to improve surface feel while maintaining target thickness, and (d) sheet count reduction while maintaining target roll diameter. Unfortunately, prior press felt designs that led to an increase in caliper or bulk were found to come at the expense of other properties, for example, sheet strength, softness, paper machine speed, and/or less efficient drying.

One such prior felt design aimed at improving bulk, known as a "differential wet press felt" or "DWP," utilized a much lower amount of sheet-side batting material covering the base core than traditional press felts, thus allowing the base core material, and associated yarn knuckles therein, to move closer to the surface of the cellulosic web and to press through the sheet-side batting when compressed in a nip along with the cellulosic web. Unfortunately, use of such press felts with reduced sheet-side batting material resulted in a weakened (reduced strength) sheet. In addition, as a consequence of lowering the amount of sheet-side batting material, such felt designs also failed to dewater uniformly and required the paper machine to be slowed down in order to reach sufficient dryness. This caused unacceptable decreased productivity. A comparison of a traditional press felt design and a prior "differential wet press felt" design may be seen in FIGS. 1 and 2, respectively.

There is thus a need for a method of making a cellulosic sheet using a press felt design on a conventional wet press machine capable of producing a sheet with increasing caliper or bulk, but without concomitant losses in sheet strength, softness, paper machine speed, and/or drying capability.

This need has been met by the methods of making improved cellulosic products using split base core and/or apertured polymeric sheet-side surface press felt designs disclosed herein, and the improved cellulosic products resulting therefrom.

SUMMARY

The disclosed embodiments herein provide inventive press felts capable of making improved cellulosic products having increasing caliper or bulk, but without concomitant losses in sheet strength, paper machine speed, and/or drying capability. In some embodiments, the inventive felts disclosed herein are characterized by having at least a first woven base core material section and a second woven base core material section, wherein the first and second base core material sections are separated by at least one fibrous batting material section.

Without wishing to be bound by theory, it is believed that, by providing a second woven base core material closer to the sheet-side of the press felt than traditional felt designs, an increase in caliper or bulk of the resultant sheet may be obtained. In addition, by providing at least one fibrous batting material in between the at least first and second woven base core materials, drying effectiveness and efficiency may be maintained. Surprisingly, the resultant sheets made from the split base core design were also found to be as strong as, or stronger than, sheets made with similar traditional press felts without the split base core design.

The present application further discloses methods of making improved cellulosic products using press felts designs having an apertured polymeric sheet-side surface, which designs are believed to lead to increased caliper and/or softness compared to cellulosic products made using traditional press felts lacking an apertured polymeric surface layer. In some embodiments, the inventive press felt may comprise both a split base core and an aperture polymeric surface layer.

DETAILED DESCRIPTION

Figure 1:
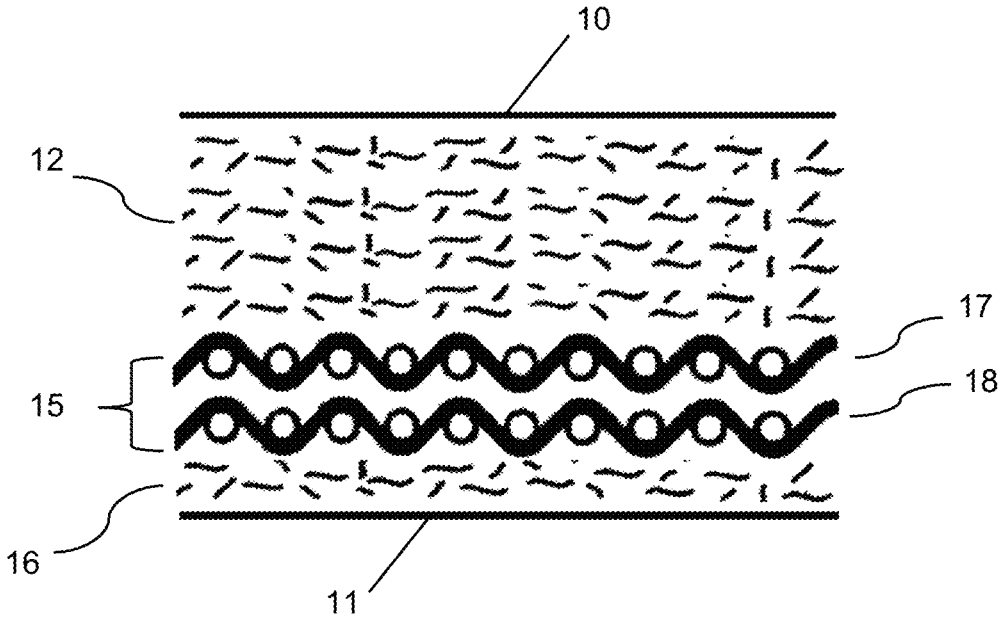
FIG. 1 depicts an exemplary comparative traditional press felt design.

In some embodiments, the methods for making improved cellulosic products according to the disclosed embodiments comprise dewatering a cellulosic web in the press section of a papermaking machine with a split base core press felt, wherein the split base core press felt comprises a sheet-side and a roll-side; a first base core material comprising a woven yarn; a second base core material comprising a woven yarn located closer to the sheet-side of the press felt than the first base core material; and a fibrous batting material located between the first and second base core materials.

In some embodiments, the split base core press felt may comprise a fibrous batting material on the sheet-side of the second base core material. In some embodiments, the split base core press felt may comprise a fibrous batting material on the roll-side of the first base core material. In some embodiments, the split base core press felt may comprise a fibrous batting material on the sheet-side of the second base core material and a fibrous batting material on the roll-side of the first base core material.

In some embodiments, the split base core press felt may comprise a third base core material comprising a woven yarn located closer to the sheet-side of the press felt than the second base core material, wherein the fibrous batting material on the sheet-side of the second base core material is located between the second base core material and the third base core material. In such embodiments, an additional fibrous batting material may further be located on the sheet-side of the third base core material.

The woven yarn of the base core material may be either the same throughout the split base core press felt or varied. In some embodiments, the type of yarn used in the first base core material may be the same as the type of yarn used in the second base core material. In some embodiments, the type of yarn used in the first base core material may be different from the type of yarn used in the second base core material. In some embodiments, where a third base core material is employed, the type of yarn used in the third base core material may be the same as, or different from, the type of yarn used in either the first or second base core materials.

The woven yarn of the base core material may be any type of yarn conventionally used in the base core of press felts, including natural yarns, synthetic yarns, or combinations thereof. The yarn may be monofilament, multifilament, or combinations thereof. In some embodiments, the yarns may be hollow. The yarn may have any conventionally used cross-sectional shape, for example round, oval, elliptical, rectangular, flat, or the like, as well as combinations thereof. The yarns may further be subject to any conventional heat treatment, chemical treatment, or the like.

The yarn of the base core material may be arranged in any woven structural arrangement conventionally used in the base core of press felts, for example woven screen structures and the like. In some embodiments, the base core material may comprise cross-machine-direction oriented ("CD") yarns. In some embodiments, the base core material may comprise machine-direction oriented ("MD") yarns. In some embodiments, the base core material may comprise both CD yarns and MD yarns. In some embodiments, the base core material may comprise CD yarns that are woven together with MD yarns to form a "woven layer." In such embodiments, the woven layer of CD yarns and MD yarns may have any conventional weave pattern configuration as between the CD yarns and the MD yarns, for example single layer, double layer, two and one-half layer, triple layer, or the like. In some embodiments, the base core material may also comprise, in addition to the woven yarn, fibrous batting entangled therethrough.

In some embodiments, one or more of the base core materials may comprise a single woven layer of CD and MD yarns. In some embodiments, at least one of the first base core material and the second base core material may comprise more than one woven layer of CD and MD yarns. In some embodiments, the first base core material may comprise more than one woven layer. In some embodiments, the second base core material may comprise more than one woven layer. In some embodiments, where a third base core material is present, the third base core material may comprise more than one woven layer. In some embodiments, comprising a first and a second base core material, the first base core material may comprise two woven layers and the second base core material may comprise one woven layer. In some embodiments comprising a first and a second base core material, the second base core material may comprise two woven layers and the first base core material may comprise one woven layer.

In some embodiments, the yarn used in the base core material may vary in coarseness (diameter). In some embodiments, the yarn in the first base core material may be coarser than the yarn in the second base core material. In some embodiments, the yarn in the second base core material may be coarser than the yarn in the first base core material. In some embodiments, where a third base core material is used, the yarn in the third base core material may be coarser than the yarn in both the first and second base core materials. In some embodiments, where a third base core material is used, the yarn in the third base core material may be less coarse than the yarn in both the first and second base core materials.

The fibrous batting material used in the split base core press felt may be any type of fibrous material conventionally used in the batting layers of press felts, including nylon, wool, and the like. In a preferred embodiment, the fibrous batting material may be nylon. In contrast to the base core material sections, the fibrous batting material sections of the split base core press felt do not contain any woven yarn.

The fibrous batting material may be either the same throughout the split base core press felt or varied. In some embodiments, the type of fibrous material used in the roll-side fibrous batting may be different from the type of fibrous material used in the batting located between the first and second base core materials. In some embodiments, the type of fibrous material used in the batting located between the first and second base core materials may be different from the type of fibrous material used in the sheet-side fibrous batting. In some embodiments, the type of fibrous material used in the roll-side fibrous batting may be different from the type of fibrous material used in the sheet-side fibrous batting.

In some embodiments, one or more of the fibrous batting material sections may comprise more than one layer of fibrous material, which layers may differ in fiber type, coarseness, or both. In some embodiments, the fibrous batting material located on the roll-side of the first base core material may comprise two or more layers, for example two, three, or four layers. In some embodiments, the fibrous batting material located between the first and second base core materials may comprise two or more layers, for example two, three, or four layers. In some embodiments, the fibrous batting material located on the sheet-side of the press felt may comprise two or more layers, for example two, three, or four layers. In some embodiments, where a third base core material is used, the fibrous batting material located between the second base core material and the third base core material may comprise two or more layers, for example two, three, or four layers.

In some embodiments, the caliper (thickness) of the fibrous batting material located between the first and second base core materials may comprise at least 10% of the caliper (thickness) of the entire split base core press felt, for example at least 20%, at least 35%, at least 50%, or at least about 70%.

In some embodiments, the coarseness of the fibrous material used in the batting sections of the split base core press felt may be either the same throughout or varied. In some embodiments, the fibrous batting material on the roll-side of the first base core material may be coarser than the fibrous batting material on the sheet-side of the second base core material. In some embodiments, the fibrous batting material located between the first and second base core materials may be coarser than the fibrous batting material on the sheet-side of the second base core material.

In some embodiments, where the fibrous batting material located between the first and second base core materials comprises two or more layers, the coarseness of the layers may decrease as they get closer to the second base core material. For example, the fibrous batting material located between the first and second base core materials may comprise two layers, wherein the fibrous layer closest to the first base core material is coarser than the fibrous layer closest to the second base core material. Similarly, for example, the fibrous batting material located in between the first and second base core materials may comprise three layers, wherein the fibrous layer closest to the first base core material is coarser than the middle fibrous layer, which is coarser than the fibrous layer closest to the second base core material.

In embodiments where the fibrous batting material located between the first and second base core materials comprises two or more layers, the coarseness of the layer closest to the second base core material may be the same as the coarseness of the fibrous batting material on the sheet-side of the second base core material. In embodiments where the fibrous batting material located between the first and second base core materials comprises two or more layers, the layer closest to the second base core material may be coarser than the fibrous batting material on the sheet-side of the second base core material.

The alternating base core materials and fibrous batting materials may be connected to one another by any conventional method known in the art, for example stitching, needling, adhesives, and the like.

In some embodiments, only fibrous batting material is located between the first and second base core materials. In such embodiments, no additional materials or layers, such as polymeric laminate, film, or foam layers, are located between the first and second base core materials.

In some embodiments, the split base core press felt may comprise layers other than woven base core layers and fibrous batting layers. In some embodiments, the split base core press felt may comprise one or more polymeric laminate, film, or foam layers. In some embodiments, the polymeric laminate, film, or foam layer may be a surface treatment or coating on the sheet-side of one or more of the base core material layers and fibrous batting layers. In some embodiments, the polymeric layer may be an independent polymeric laminate, film, or foam layer interposed between one or more of the base core layers and the fibrous batting layers. In some embodiments, the polymeric layer may be formed in-situ on one or more of the base core layers and the fibrous batting layers by the application of heat, melting the surface yarn in a base core layer or the surface batting in a fibrous batting layer to form a polymeric layer.

In some embodiments, the total grammage and caliper of the split base core press felt may be similar to that employed in traditional press felt designs, but with the base core material in a split configuration with part of the base core material moved up closer to the sheet-side of the press felt than the single base core in traditional designs. Without wishing to be bound by theory, it is believed that, by altering the design of the felt in this manner, while keeping the caliper and grammage of the felt the same, there is improved room for water to flow out of the sheet and into the felt without the need to slow the machine down. In addition, by moving a second base core material up closer to the sheet-side surface, the knuckles of the woven second base core material yarn are able to more significantly interact with the cellulosic sheet surface, thus impacting the topography of the sheet surface by creating more defined areas of high and low density, which are visible as raised dome-like structures and lowered dimple-like structures. This is believed to lead to the formation of cellulosic sheets with increased caliper and/or bulk, without loss of drying effectiveness, efficiency, or resultant sheet strength or softness.

In some embodiments, the polymeric layer may have a perforated or apertured structure to allow for the pass-through of water. In some embodiments, the first base core material may comprise a polymeric laminate on the sheet-side. In some embodiments, the second base core material may comprise a polymeric laminate on the sheet-side. In some embodiments, the fibrous batting material closest to the sheet side may have a polymeric laminate on the sheet-side of the batting material.

The present application further discloses improved cellulosic products and methods of making improved cellulosic products using press felts design having an apertured polymeric sheet-side surface. In some embodiments, holes may be drilled into the fibrous batting material closest to the sheet-side of a press felt, causing heat friction to melt or cauterize the surface fibers and to create an "apertured polymeric surface" layer in-situ on the sheet-side of the press felt. According to some embodiments, a press felt is disclosed with an apertured polymeric surface layer on the sheet side of the felt, wherein the felt is a split base core press felt. According to some embodiments, a press felt is disclosed with an apertured polymeric surface layer on the sheet side of the press felt, wherein the felt contains only a single base core material section. In such embodiments, the single base core material section may be surrounded by a roll-side fibrous batting material section, and a sheet-side fibrous batting material section with an apertured polymeric surface layer on the sheet-side surface of the press felt. In such embodiments, the present inventor has found that both caliper and softness may be improved compared to the use of a traditional press felt that lacks an apertured polymeric surface layer on the sheet-side of the press felt.

The present application discloses embodiments for making cellulosic products using the inventive press felts disclosed herein. The inventive press felts disclosed herein may be used in any conventional type of papermaking machine that utilizes a press felt. In some embodiments, the inventive press felts may be used in the press section of a papermaking machine. In some embodiments, the inventive press felts may be used in the press section, following the forming section. In some embodiments, the method of making a cellulosic product comprises conveying a wet cellulosic web through at least one press nip along with an inventive press felt as disclosed herein. In some embodiments, the inventive press felt carries the wet cellulosic web through the at least one press nip where pressure is applied to the cellulosic web and press felt, and wherein water is removed from the web and transferred to the press felt. In some embodiments, the wet cellulosic web may be conveyed through at least one press nip with an inventive press felt on both sides of the web. In some embodiments, the wet cellulosic web may be conveyed through more than one press nip with at least one inventive press felt as disclosed herein. In some embodiments, the cellulosic products may further undergo additional operations following the press section, including drying, creping, finishing, converting, calendering, embossing, and the like.

The methods described herein may be used to manufacture, for example, consumer cellulosic products, such as tissue, towel, napkin products, and the like. In some embodiments, the product may be a tissue product, such as a bath tissue, facial tissue, baby tissue, or the like. In some embodiments, the product may be a towel product, such as a paper towel, wipe, or the like. In some embodiments, the product may be a napkin, a table cover, or the like.

In some embodiments, the cellulosic products may exhibit increased caliper or bulk, with the same or higher tensile strengths as compared to cellulosic products made with traditional press felts. The methods described herein using the inventive split base core and/or apertured polymeric sheet-side surface press felts may further be conducted without reducing drying efficiency or machine speed as compared to use of a traditional press felt. In particular, it was found that the inventive press felts resulted in similar solids after pressing, as compared to the use of traditional press felts.

In some embodiments, the cellulosic products made using the inventive press felts may exhibit an increase in caliper from about 5% to about 30%, as compared to the caliper of an identical cellulosic product made with a press felt comprising the same felt caliper and grammage, but without an aperture polymeric surface and with only a single base core material. In some embodiments, the increase in caliper may be at least about 5%, for example at least about 10%, at least about 15%, at least about 20%, or at least about 25%.

In some embodiments, the cellulosic products made using the inventive press felts may exhibit an increase in bulk from about 5% to about 30%, as compared to the bulk of an identical cellulosic product made with a press felt comprising the same felt caliper and grammage, but without an aperture polymeric surface and with only a single base core material. In some embodiments, the increase in bulk may be at least about 5%, for example at least about 10%, at least about 15%, at least about 20%, or at least about 25%.

In some embodiments, the cellulosic products made using the inventive press felts may exhibit a ratio of caliper (mils/8 sheet) to basis weight (lb/3000 $ft^2$) of at least about 3, for example at least about 3.5, at least about 4, at least about 4.5, at least about 5, or at least about 5.5. In some embodiments, the ratio of caliper (mils/8 sheet) to basis weight (lb/3000 $ft^2$) may range from at least about 3 to at least about 6, for example, from at least about 3.5 to at least about 6, from at least about 4 to at least about 6, or from at least about 5 to at least about 6.

In some embodiments, the method of making the cellulosic product may further comprise calendering the cellulosic product following the press section of the papermaking machine. Calendering may be used to improve sheet softness, smoothness, or both. In general, calendering also leads to a decrease in bulk or caliper. In accordance with the methods of the present application, a calendered cellulosic product may be made which exhibits increased softness or smoothness, but still with comparable or increased bulk or caliper due to the gains achieved by using the split base core press felts of the present application. Likewise, increased levels of embossing may be achieved with comparable or increased bulk or caliper due to the gains achieved by using the split base core press felt.

In some embodiments, the cellulosic products made using the inventive press felts may exhibit an increase in bulk or caliper, while maintaining or increasing tensile strength, as compared to an identical cellulosic product made with a press felt comprising the same felt caliper and grammage, but without an aperture polymeric surface and with only a single base core material.

In some embodiments, the cellulosic products made using the inventive press felts may exhibit a machine direction dry tensile strength ("MD" or "MDT") of at least about 600 g/3 in, for example, at least about 700 g/3 in, at least about 800 g/3 in, at least about 900 g/3 in. In some embodiments, the cellulosic products may exhibit a cross-machine direction dry tensile strength ("CD" or "CDT") of at least about 300 g/3 in, for example, at least about 400 g/3 in, at least about 500 g/3 in. In some embodiments, the cellulosic products may exhibit a geometric mean dry tensile strength ("GM" or "GMT") of at least about 400 g/3 in, for example, at least about 500 g/3 in, at least about 600 g/3 in. MD and CD tensile strengths may be measured with a standard Instron® test device or other suitable elongation tensile tester that may be configured using 3 inch (76.2 mm) or 1 inch (25.4 mm) wide strips of tissue or towel, conditioned in an atmosphere of 23±1° C. (73.4±1° F.) at 50% relative humidity for 2 hours. The tensile test is run at a crosshead speed of 2 in/min (50.8 mm/min). GM tensile strength may be calculated from the CD and MD tensile strengths by taking the square root of the result of the MD tensile strength multiplied by the CD tensile strength.

In some embodiments, the cellulosic products made using the inventive press felts may exhibit a ratio of caliper (mils/8 sheet) to basis weight (lb/3000 $ft^2$) of at least about 3.5, with a GM tensile strength of at least about 500 g/3 in. In some embodiments, the cellulosic products may exhibit a ratio of caliper (mils/8 sheet) to basis weight (lb/3000 $ft^2$) of at least about 3.5, with a GM tensile strength of at least about 550 g/3 in. In some embodiments, the cellulosic products may exhibit a ratio of caliper (mils/8 sheet) to basis weight (lb/3000 $ft^2$) of at least about 4.5, with a GM tensile strength of at least about 500 g/3 in. In some embodiments, the cellulosic products made using the inventive press felts may exhibit a ratio of caliper (mils/8 sheet) to basis weight (lb/3000 $ft^2$) of at least about 5, with a GM tensile strength of at least about 500 g/3 in.

In some embodiments, the cellulosic products made using the inventive press felts may exhibit a softness comparable to, or better than, comparable products made with a traditional press felt. In some embodiments, the cellulosic products may exhibit a softness of at least about 18, for example at least about 18.5, for example at least about 19. Softness can be determined by using a panel of trained human subjects in a test area conditioned to TAPPI standards (temperature of 71.2° F. to 74.8° F., relative humidity of 48% to 52%). The softness evaluation relies on a series of physical references with predetermined softness values that are always available to each trained subject as they conducted the testing. Angel Soft® was assigned a softness of 17.3, Quilted Northern Ultra Soft® a value of 18.2, and Charm in Ultra Soft® a value of 18.7. The trained subjects directly compare test samples to the physical references to determine the softness level of the test samples. The trained subjects then assign a number to a particular paper product, with a higher sensory softness number indicating a higher perceived softness. A product must have a softness of at least 16 to be considered a "premier product."

Figure 2:
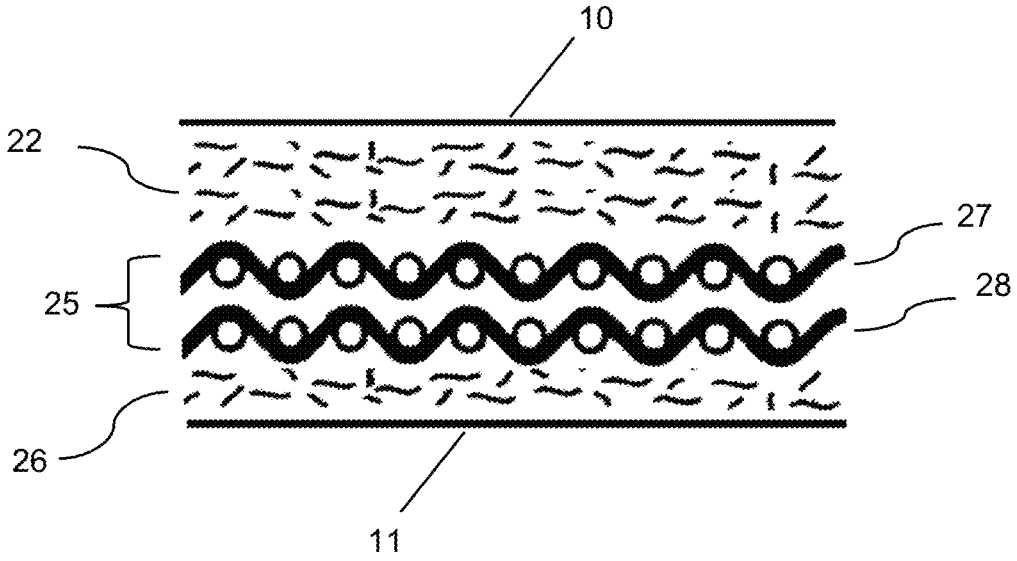
FIG. 2 depicts an exemplary comparative "differential wet press felt" design.

FIG. 1 depicts a comparative traditional press felt design and FIG. 2 depicts a comparative "differential wet press felt" design. Each of the comparative traditional and comparative "differential wet press felt" designs comprise a sheet side (10) and a roll side (11). Each of the comparative traditional and comparative differential wet press felt designs comprise only a single base core material (15 in FIGS. 1 and 25 in FIG. 2). In the examples in FIGS. 1 and 2, the single base core material is made up of two layers of woven CD and MD yarn (17 and 18 in FIGS. 1 and 27 and 28 in FIG. 2), surrounded by a roll-side fibrous batting material (16 in FIGS. 1 and 26 in FIG. 2), and a sheet-side fibrous batting material (12 in FIGS. 1 and 22 in FIG. 2). The differential wet press felt design (FIG. 2) contains a decreased amount of sheet-side fibrous batting (22) as compared to the traditional press felt design (12 in FIG. 1), and thus a lower grammage and felt caliper.

Figure 3:
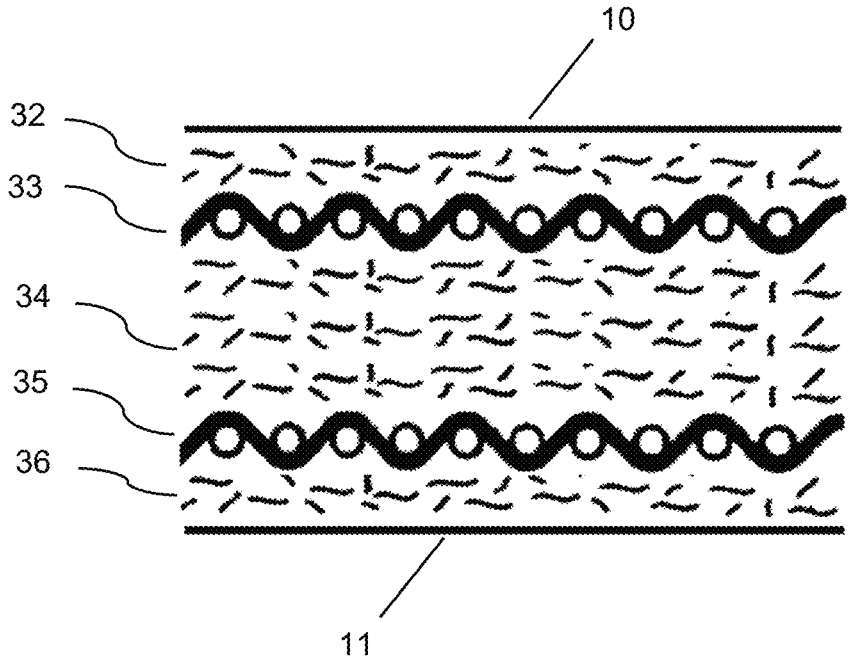
FIG. 3 depicts an exemplary embodiment of a split base core press felt designs according to the present application, with a first base core material having a single layer of woven yarn.
Figure 4:
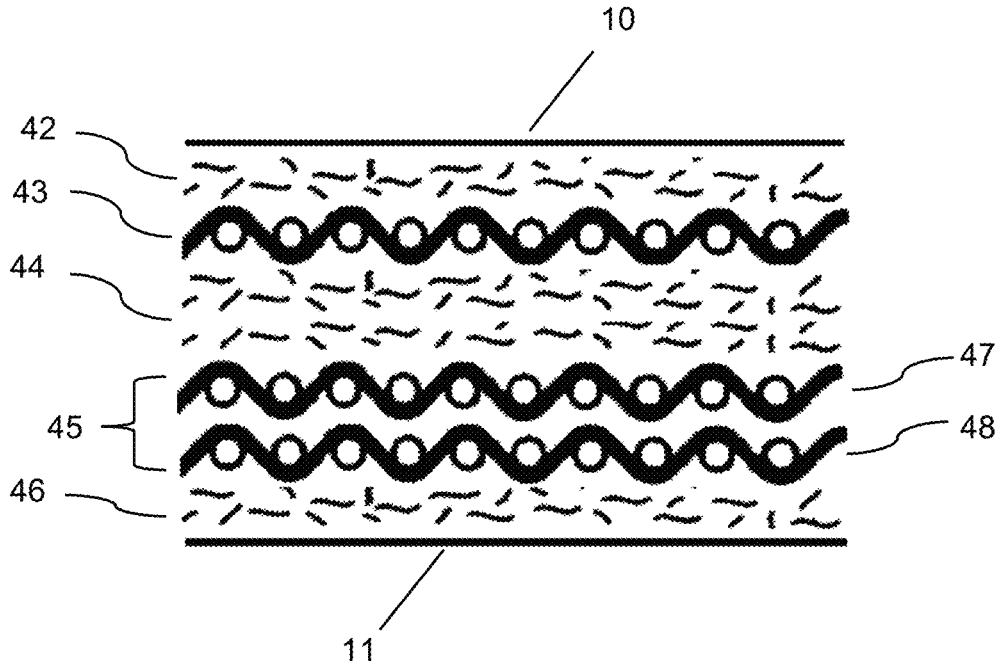
FIG. 4 depicts an exemplary embodiment of a split base core press felt designs according to the present application, with a first base core material having two layers of woven yarn.

FIGS. 3 and 4 depict exemplary embodiments of a split base core press felt designs according to the present application. The exemplary split base core press felt embodiments shown in FIGS. 3 and 4 contains a sheet-side (10) and a roll-side (11), a first base core material (35 in FIGS. 3 and 45 in FIG. 4), a second base core material (33 in FIGS. 3 and 43 in FIG. 4), and a fibrous batting material located between the first and second base core materials (34 in FIGS. 3 and 44 in FIG. 4). The exemplary split base core press felt embodiments shown in FIG. 3 and FIG. 4 further comprise a fibrous batting material on the sheet-side of the second base core material (32 in FIGS. 3 and 42 in FIG. 4) and a fibrous batting material on the roll-side of the first base core material (36 in FIGS. 3 and 46 in FIG. 4).

In the exemplary split base core press felt in FIG. 4, the first base core material is made up of two layers of woven CD and MD yarn (47 and 48). In some examples, the second base core material, either instead of or in addition to the first base core material, may also have two or more layers of woven yarn. Similarly, in some embodiments, one or more of the batting material sections may have one or more layers of fibrous batting material.

Figure 5:
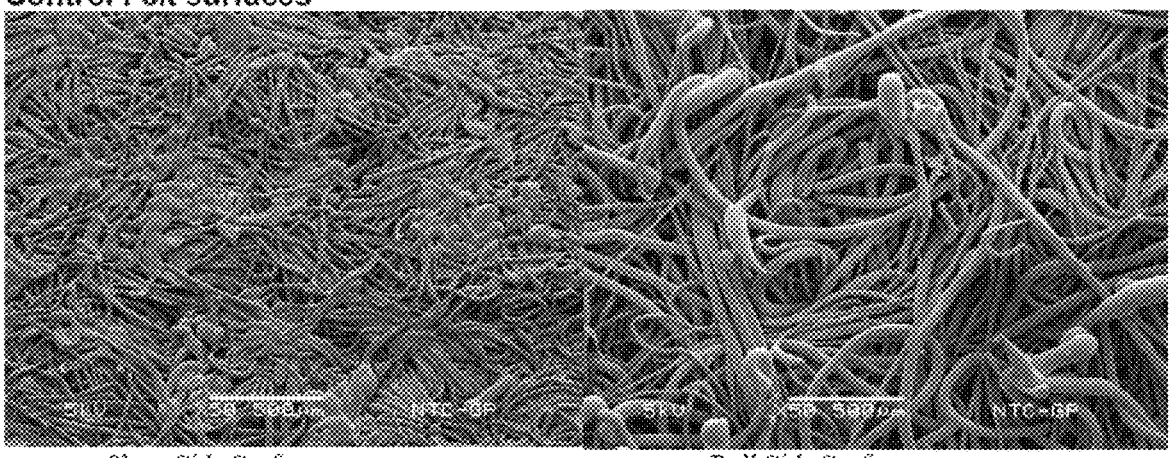
FIG. 5 depicts sheet side surface, roll side surface, CD cross-section, and MD cross-section Scanning Electron Microscope (SEM) photographs of a comparative traditional press felt design.
Figure 5:
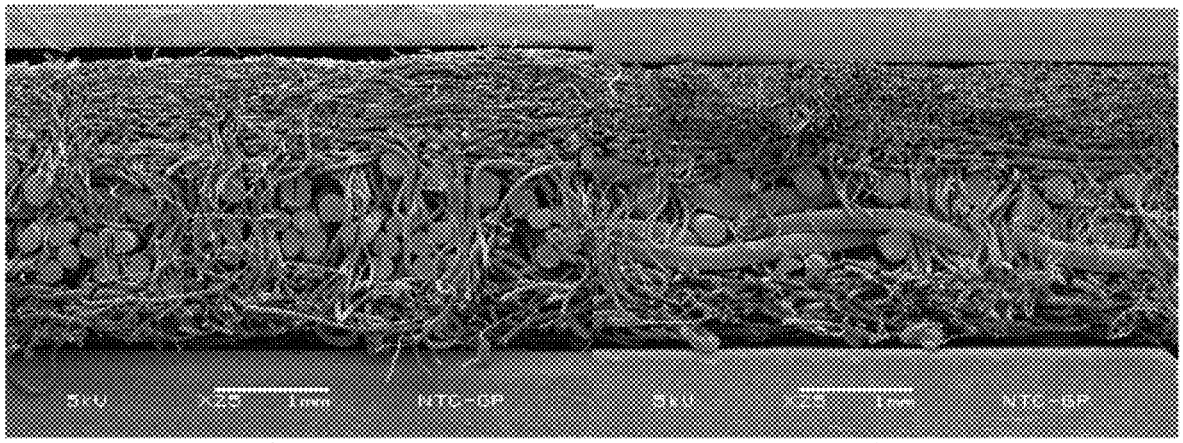

FIG. 5 depicts sheet side surface, roll side surface, CD cross-section, and MD cross-section Scanning Electron Microscope (SEM) photographs of a comparative traditional press felt design.

Figure 6:
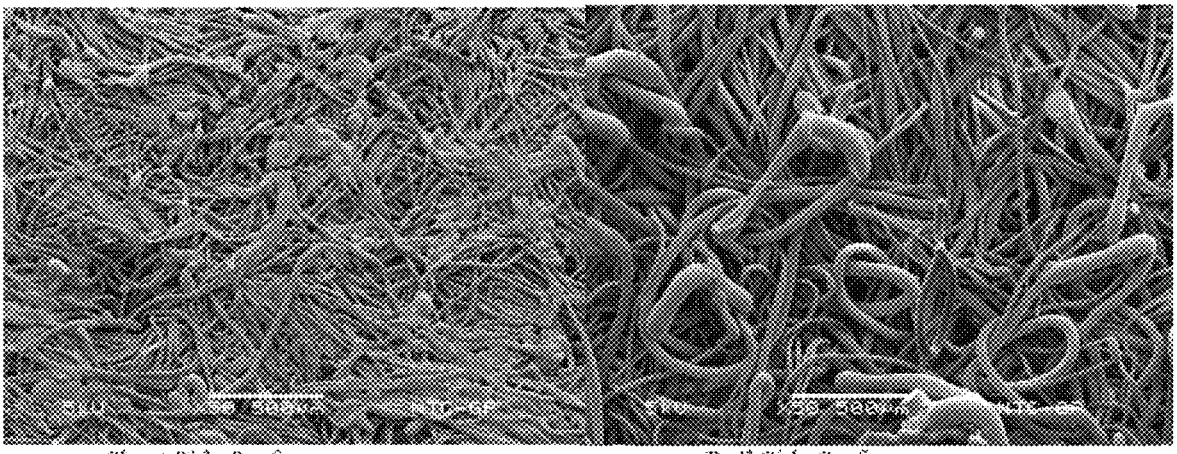
FIG. 6 depicts sheet side surface, roll side surface, CD cross-section, and MD cross-section Scanning Electron Microscope (SEM) photographs of an exemplary split base core press felt design according to the present application.
Figure 6:
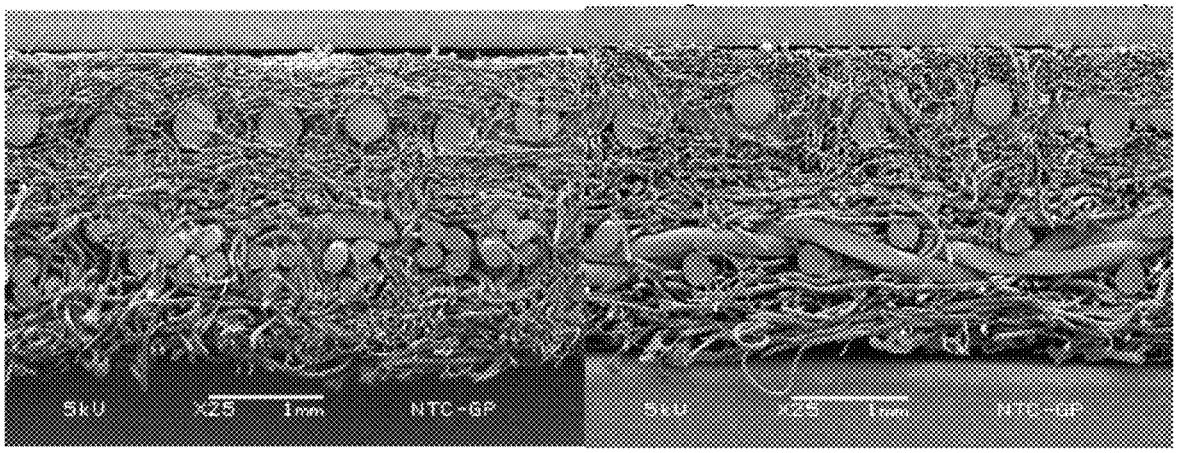

FIG. 6 depicts sheet side surface, roll side surface, CD cross-section, and MD cross-section Scanning Electron Microscope (SEM) photographs of an exemplary split base core press felt design according to the present application.

Figure 7:
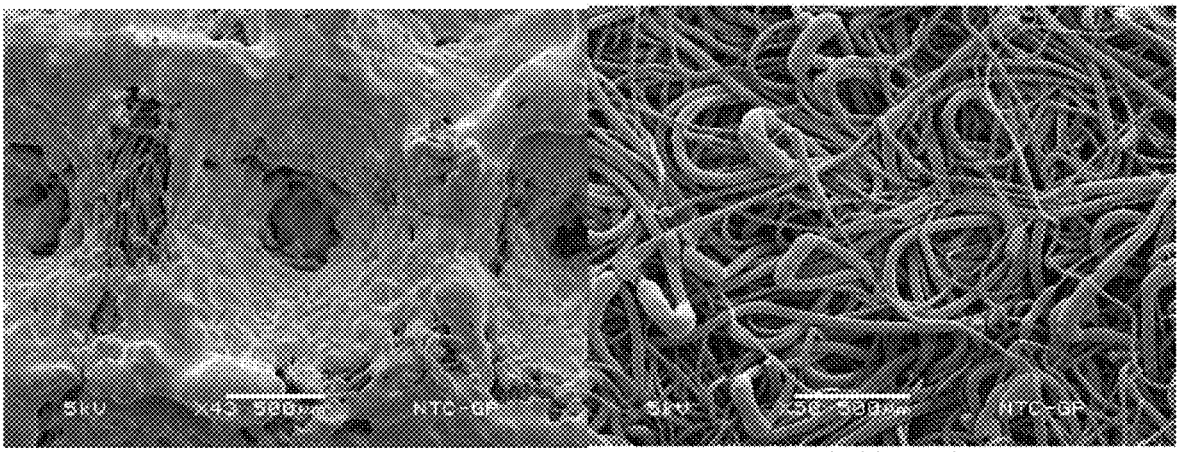
FIG. 7 depicts sheet side and roll side surfaces of a press felt that has had holes drilled into the sheet-side surface of the sheet-side batting layer, forming an aperture polymeric surface on the sheet-side surface of the press felt, in accordance with some embodiments of inventive press felts disclosed herein.

FIG. 7 depicts sheet side and roll side surfaces of a press felt that has had holes drilled into the sheet-side surface of the sheet-side batting layer, forming an aperture polymeric surface on the sheet-side surface of the press felt, in accordance with some embodiments of inventive press felts disclosed herein.

Descriptions of the disclosed embodiments are not exhaustive and are not limited to the precise forms or exemplary embodiments disclosed. Modifications and adaptations of the exemplary embodiments will be apparent from consideration of the specification and practice of the disclosed embodiments.

EXAMPLES

Example 1

Six handsheets were formed in a British sheet mould using standard Tappi procedures but with some modifications to pressing. The furnish for this study was an unrefined 100% southern softwood kraft. Sheets were formed on the wire on the sheet mould and then transferred onto two thick blotter stock in preparation for pressing. A felt which had been previously prepared and soaked in water for more than 24 hours was placed on the sheet noting the machine direction and cross machine direction as determined by the felt direction on the sheet. The felt and a sheet were placed in a mechanical press and subjected to a pressing load of approximately 870 psi for 30 seconds. The felt was removed and the sheet was dried on a drum dryer, conditioned, and tested for physical properties. The procedure was repeated for each of the six felts, one comparative and five in accordance with the present application.

The control press felt utilized in this study was a Hydromax™ II felt made by Albany International with a DYNATEX® 0.25-0.25 nylon fibrous material as the batting material on the sheet-side of the base core. The control press felt had only a single base core material and no aperture polymeric surface. SEM cross sections of the control felt are shown in FIG. 5. Four inventive press felts according to the present disclosure (Ex. 1-4) were made using the same base core material and roll-side fibrous batting material as the control, but with a split base core design, and with the sheet-side fibrous batting and fibrous batting material located between the first and second base core materials made from one of DYNATEX® 0.25/0.25, DYNATEX® 3.3, AperTech™ 3, AperTech™ 5, or AperTech™ 7 nylon fibers. Inventive Ex. 5 was a press felt according to another embodiment of the present invention, with an apertured polymeric surface layer on the sheet side of the press felt as shown in FIG. 7, and containing only a single base core material section.

Figure 8:
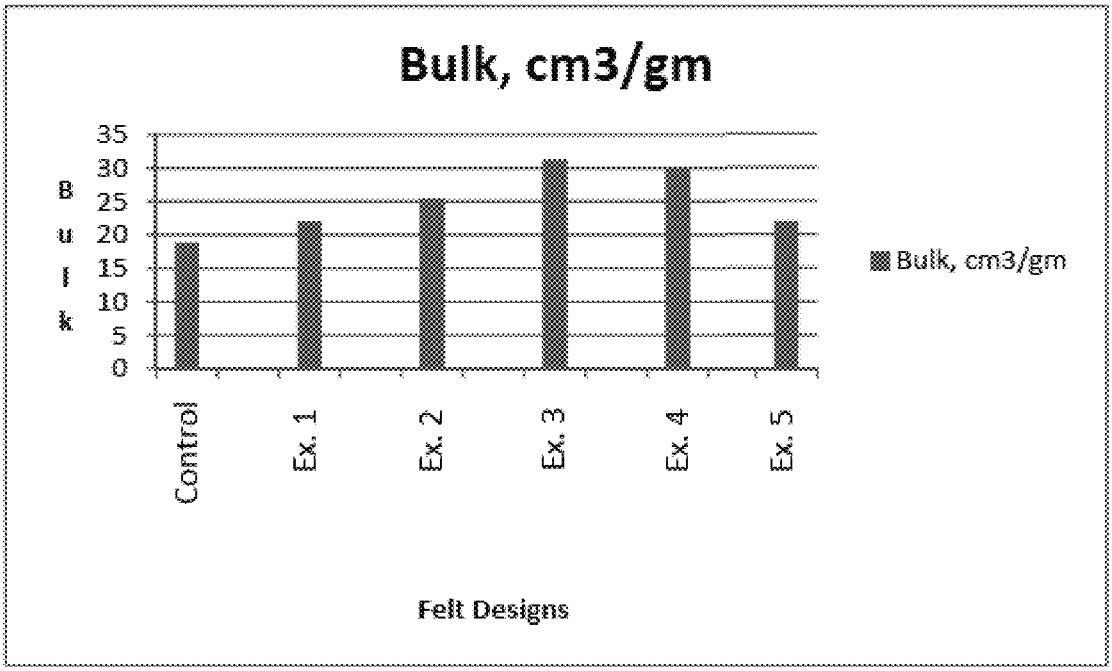
FIG. 8 depicts a comparison of bulk attributes of basesheets made using a Control felt and felts according to the present disclosure (Ex. 1-5).
Figure 9:
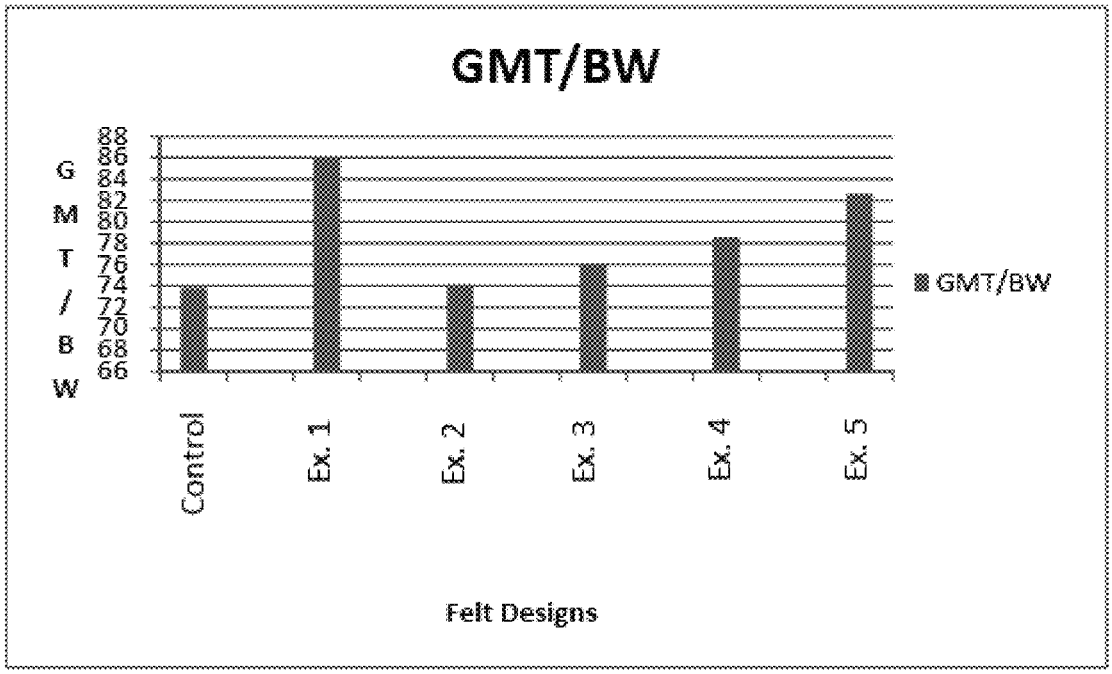
FIG. 9 depicts a comparison of geometric mean tensile strength attributes of basesheets made using a Control felt and felts according to the present disclosure (Ex. 1-5).

The handsheets made using each of the six press felts were then tested for caliper/bulk and strength. Single sheet caliper was calculated as bulk, the results of which are shown in FIG. 8 and Table 1 below. Strength was measured per the direction of the press felt as machine direction tensile strength ("MDT") and cross-machine direction tensile strength ("CDT"). The geometric mean tensile strength ("GMT") was calculated and normalized for the differences in basis weights of the handsheets. The results of the strength measurements are shown in FIG. 9 and Table 1 below.

TABLE 1

| | Basis Weight | | Tensile Strength | | Stretch | | | | |
|---|---|---|---|---|---|---|---|---|---|
| | lb/ 3000 sq ft | Caliper mil/sht | MDT, g/1" | CDT, g/1" | MDS, % | CDS, % | Bulk, cm3/gm | GMT | GMT/BW |
| Control | 16.6 | 2.9 | 1162 | 1292 | 3.1 | 2.3 | 18.8 | 1225 | 73.81 |
| Ex. 1 | 18.2 | 3.5 | 1484 | 1648 | 3.0 | 2.6 | 22.0 | 1564 | 85.93 |
| Ex. 2 | 18.0 | 3.4 | 1411 | 1261 | 2.7 | 2.7 | 25.4 | 1334 | 74.11 |
| Ex. 3 | 17.9 | 3.6 | 1312 | 1413 | 2.6 | 3.2 | 31.3 | 1362 | 76.07 |
| Ex. 4 | 16.3 | 3.1 | 1210 | 1354 | 2.8 | 3.3 | 29.9 | 1280 | 78.53 |
| Ex. 5 | 17.6 | 3.6 | 1612 | 1312 | 3.0 | 2.6 | 22.0 | 1454 | 82.63 |

The results in Table 1 and FIG. 8 show a significant difference in the bulk properties of the handsheets made with the inventive press felts of the present application, as compared to the control felt. Each of the handsheets made with the inventive split base core press felts of the present application (Ex. 1-4) and apertured polymeric surface layer felt (Ex. 5) exhibited higher caliper/bulk properties compared to the control, with Ex. 3 and Ex. 4 exhibiting the greatest increases in bulk. Such an increase in bulk properties of the resultant handsheets made with the inventive press felts of the present application was surprising.

Table 1 and FIG. 9 further show results that are equally surprising, indicating that there were no significant losses or reduction in the strength properties of sheets made with the inventive press felts when compared to the control in this study. In fact, each of the sheets made using the inventive press felts according to the present application showed at least some increase in strength properties while also exhibiting increases in caliper/bulk.

Example 2

Seven basesheets were formed on a pilot papermaking machine, each using a different press felt design. A furnish blend of 50/50 hardwood kraft/southern softwood kraft was used to make the basesheets, with StaLok 2156 as a dry strength additive in this example. The basesheets were made at a basis weight of about 12 lb/ream.

A Hydromax™ II felt made by Albany International was used as the control press felt. Five inventive press felts according to the present disclosure (Ex. 6-10) were made using the same base core material and roll-side fibrous batting material as the control, but with a split base core design, and with the sheet-side fibrous batting and fibrous batting material located between the first and second base core materials made from one of Dynatex® 0.25/0.25, DYNATEX® 3.3, AperTech™ 3, AperTech™ 5, or AperTech™ 7 nylon fibers. Inventive Ex. 11 was a press felt according to another embodiment of the present invention, with an apertured polymeric surface layer on the sheet side of the press felt as shown in FIG. 7, and containing only a single base core material section.

Figure 10:
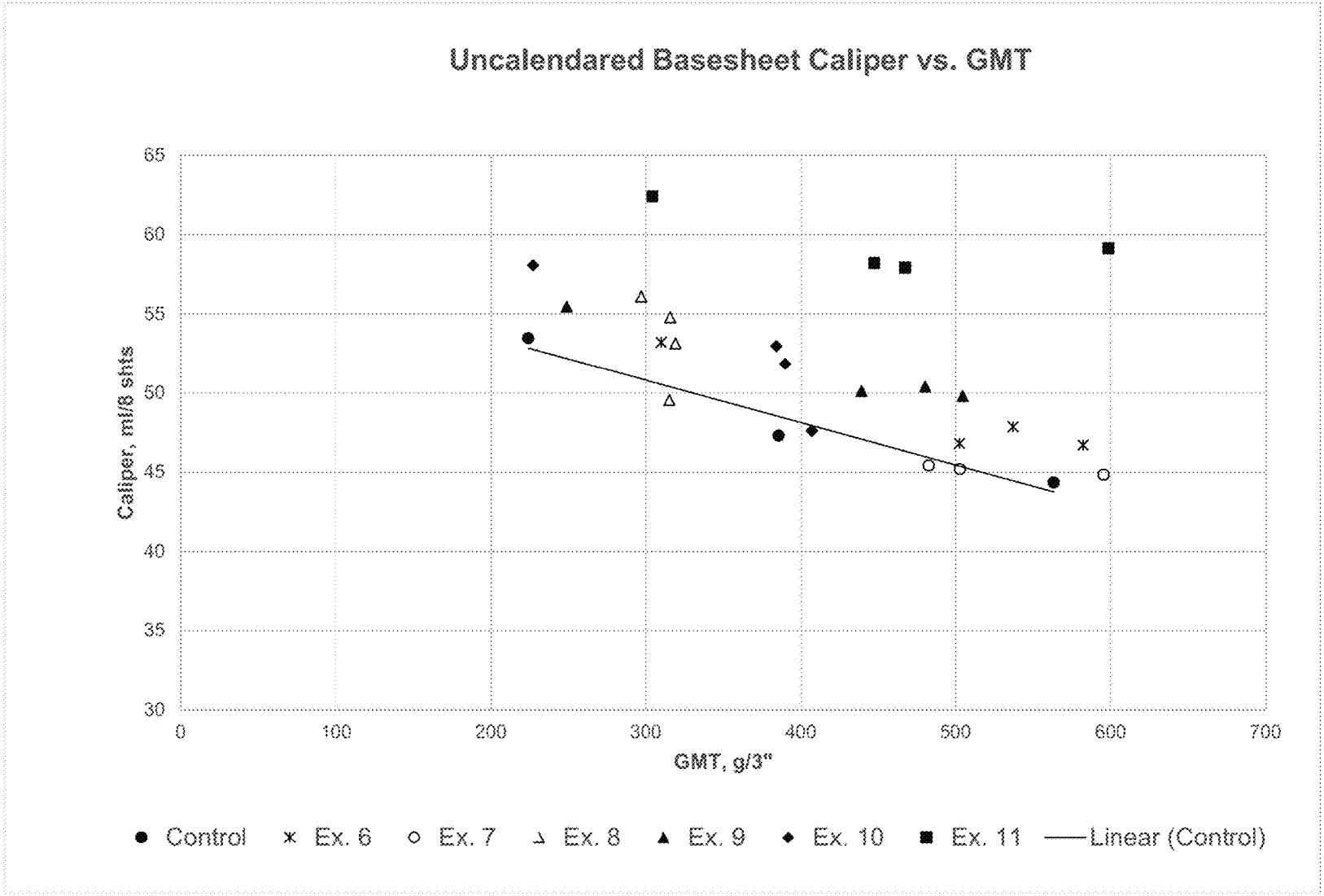
FIG. 10 depicts a comparison of caliper attributes of uncalendered basesheets made using a Control felt and felts according to the present disclosure (Ex. 6-11).
Figure 11:
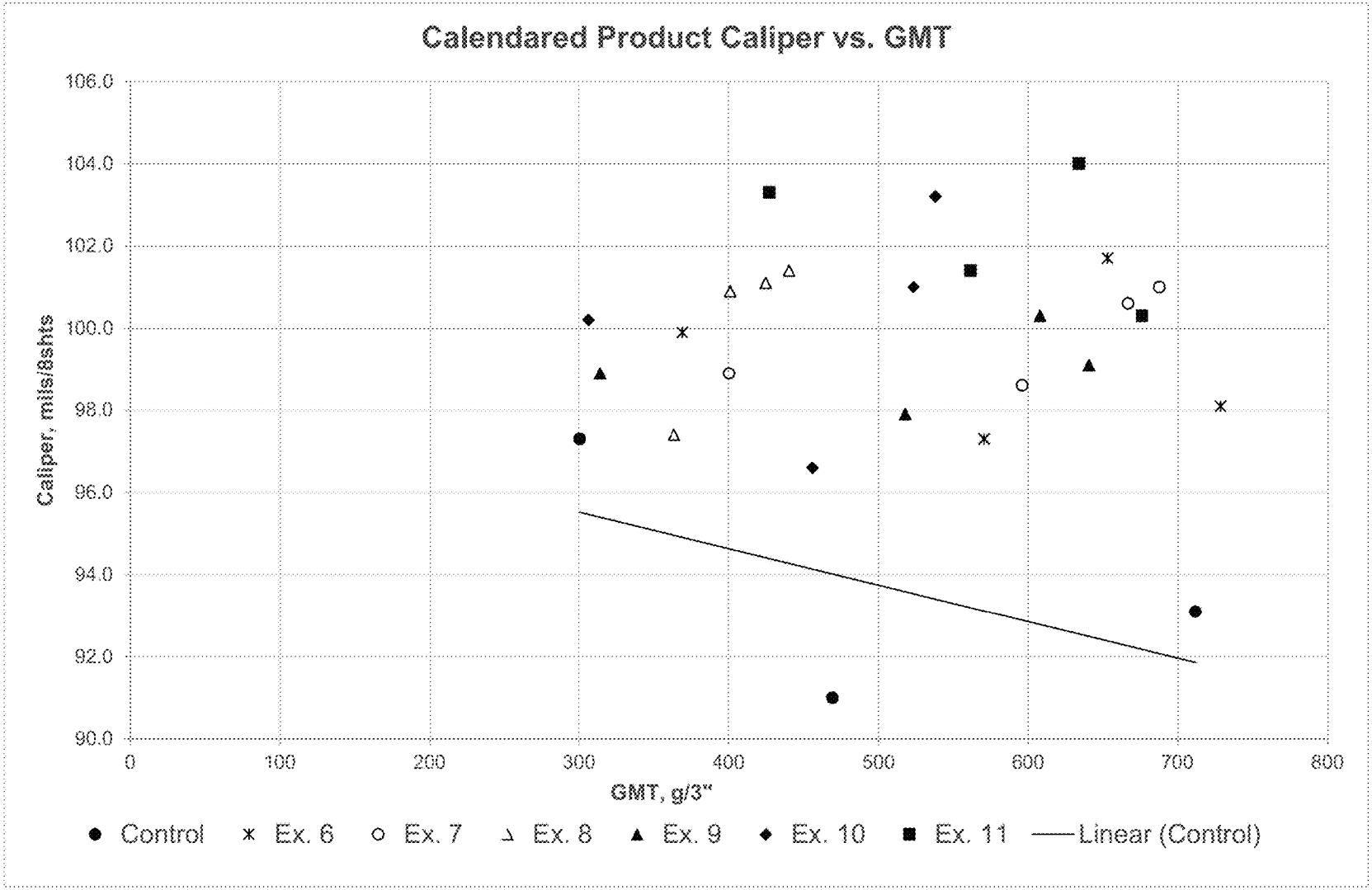
FIG. 11 depicts a comparison of caliper attributes of calendered converted cellulosic products made using a Control felt and felts according to the present disclosure (Ex. 6-11).

The caliper properties of the basesheets made using each of the seven press felt designs were measured, both before and after calendering. The caliper results for samples of the uncalendered basesheets are shown in FIG. 10 as a function of geometric mean tensile strength. The caliper results for samples of the calendered converted finished product are shown in FIG. 11 as a function of geometric mean tensile strength. In each case, the caliper of the basesheets made with the inventive felt designs of the present application (Ex. 6-11) were superior to the caliper/bulk of the basesheets made with control press felt design.

Figure 12:
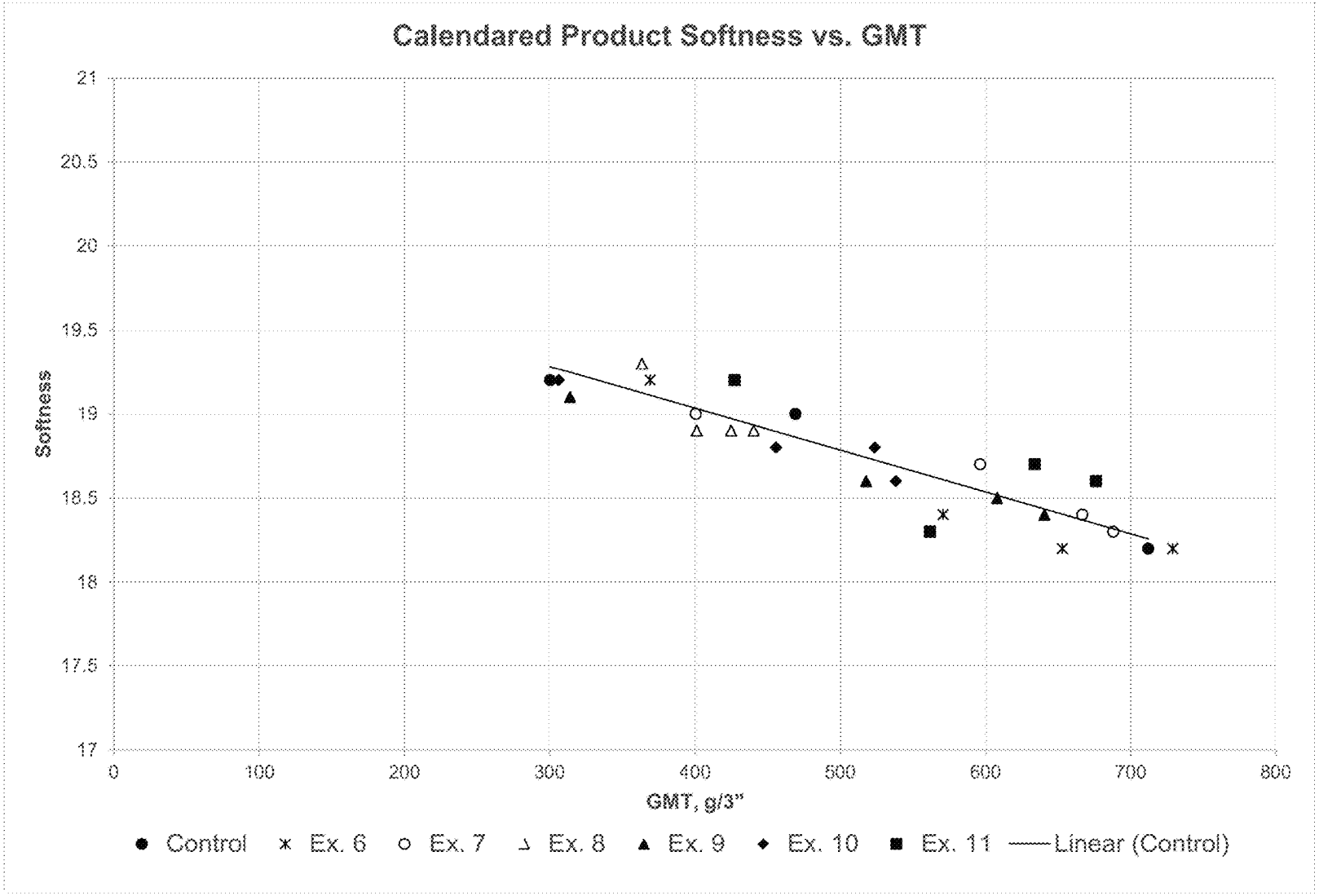
FIG. 12 depicts a comparison of softness attributes of converted cellulosic products made using a Control felt and felts according to the present disclosure (Ex. 6-11).

As shown in FIG. 12, softness was also measured for each of the calendered converted finished products made using the six inventive press felt designs, showing that the calendered converted finished product made with inventive press felt Ex. 6-11 did not exhibit any significant decrease in softness compared to the calendered converted finished product made with the control press felt.

Example 3

Figure 13:
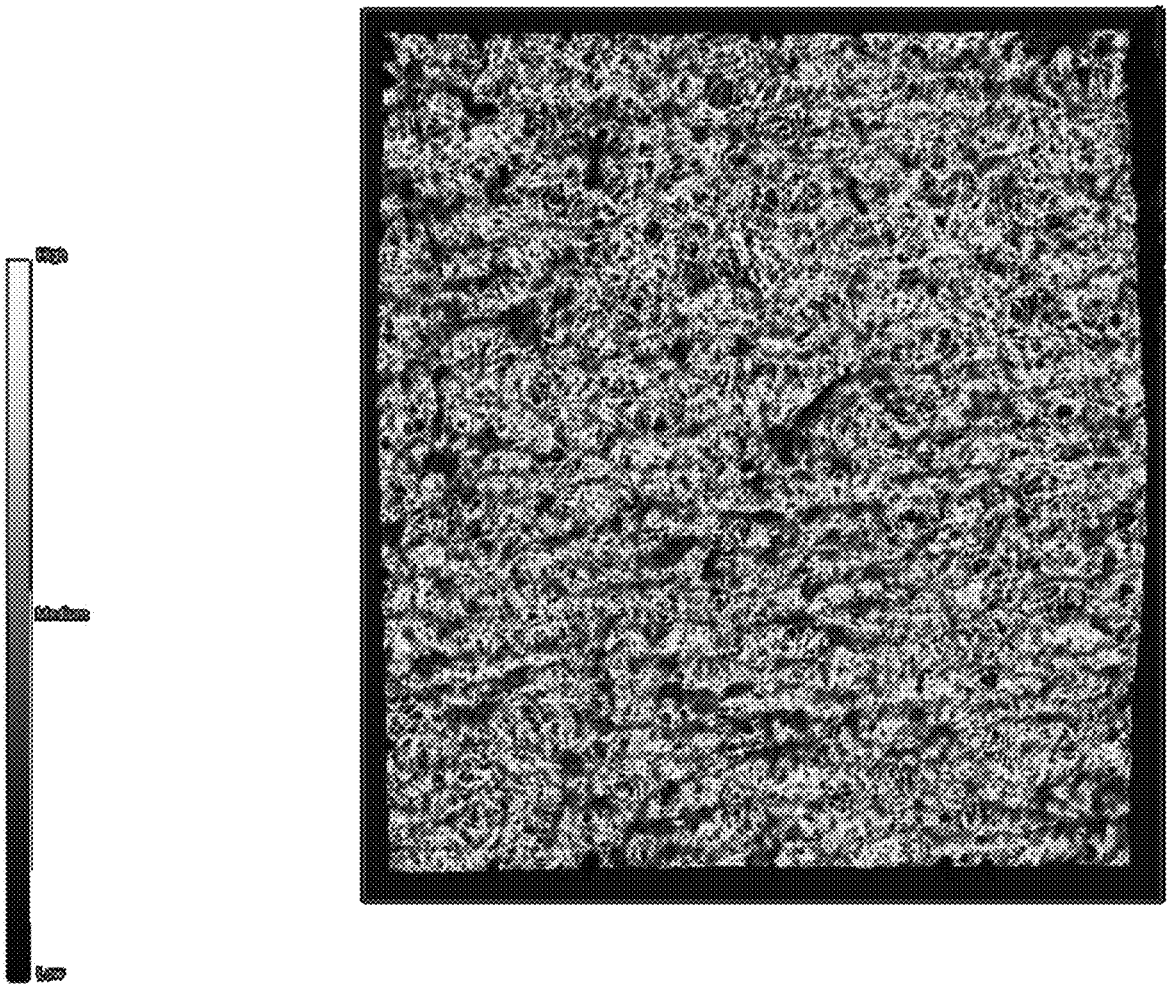
FIG. 13 depicts an image taken by CT scanning microscopy of the sheet-side surface of a basesheet made using a comparative traditional press felt design.
Figure 14:
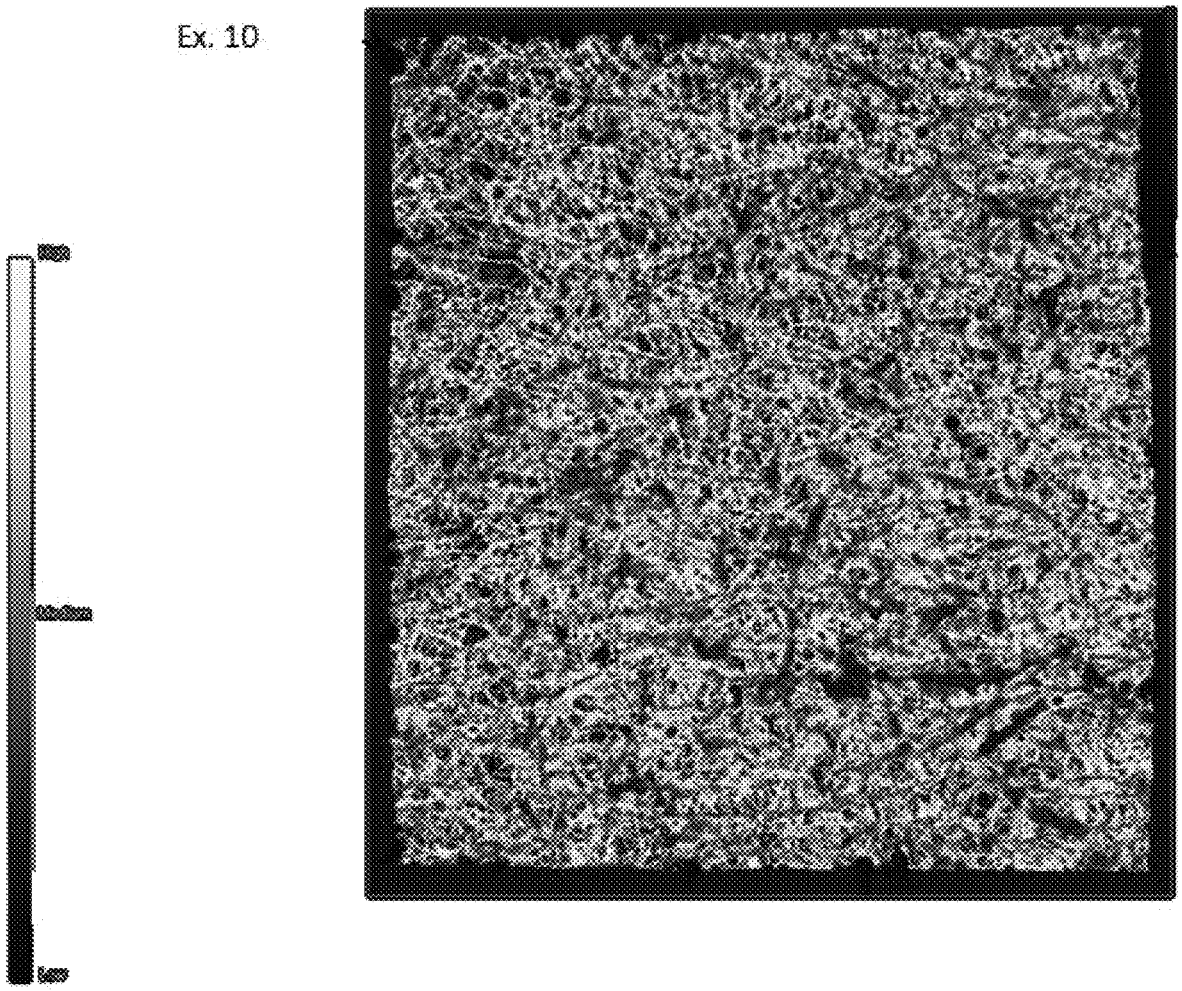
FIG. 14 depicts an image taken by CT scanning microscopy of the sheet-side surface of a basesheet made using a split core press felt design according to the present disclosure (Ex. 10).
Figure 15:
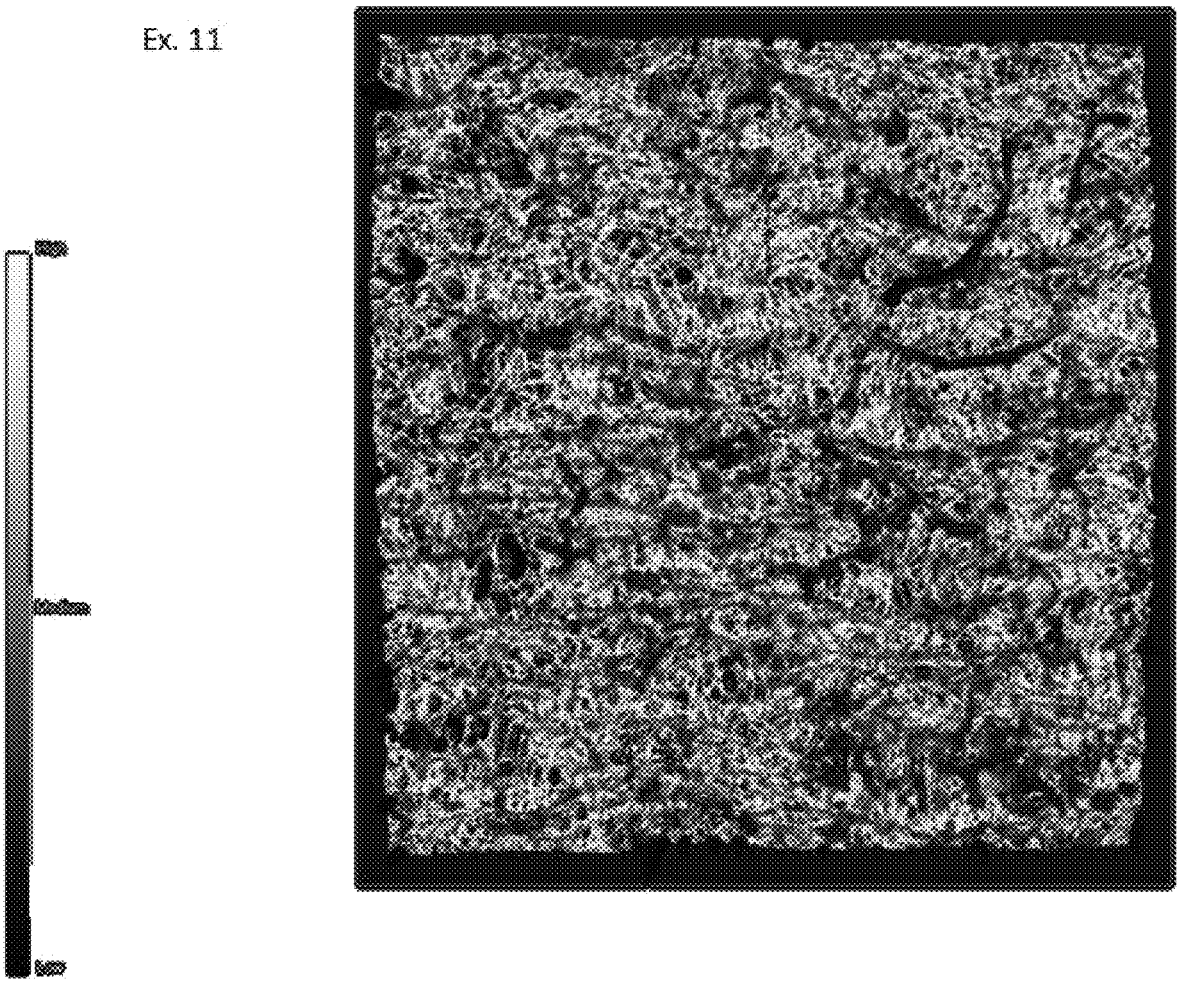
FIG. 15 depicts an image taken by CT scanning microscopy of the sheet-side surface of a basesheet made using a press felt design with an apertured polymeric surface according to the present disclosure (Ex. 11).
Figure 16:
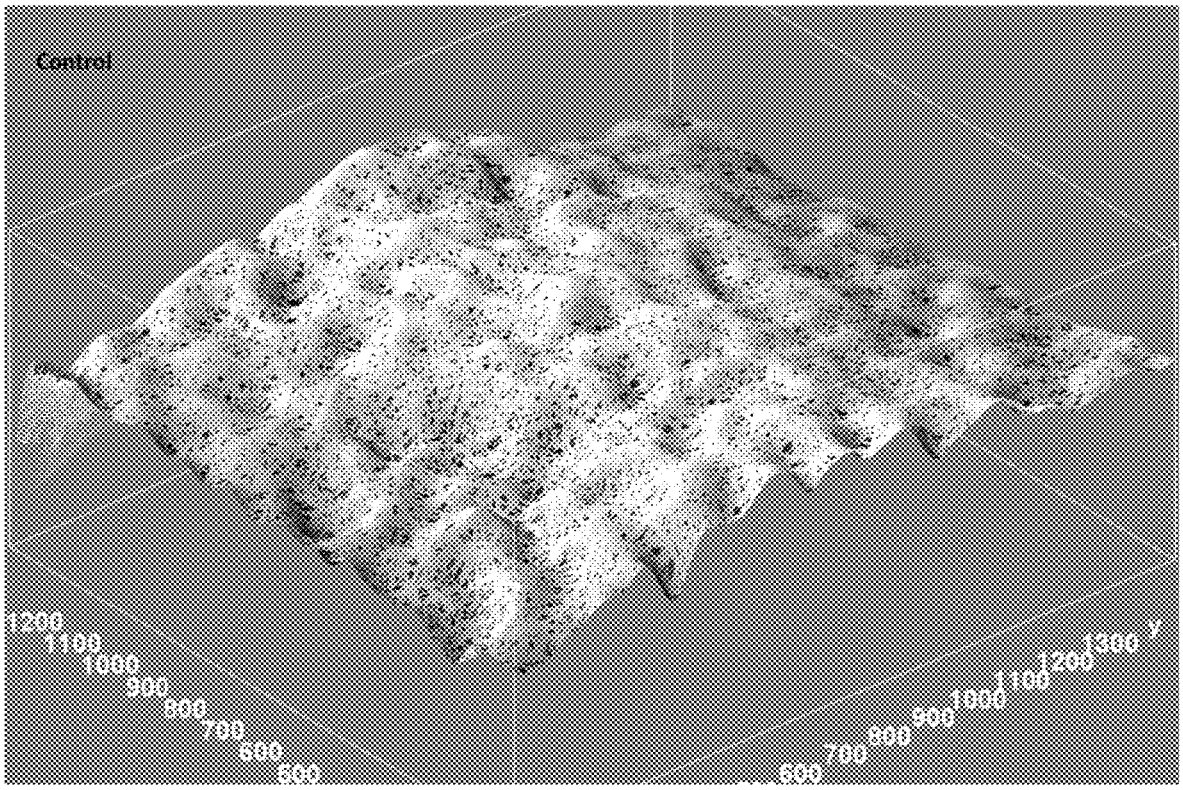
FIG. 16 depicts an image profiled to show the surface topography of the CT scanning microscopy image from FIG. 13 of the sheet-side surface of a basesheet made using a comparative traditional press felt design.
Figure 17:
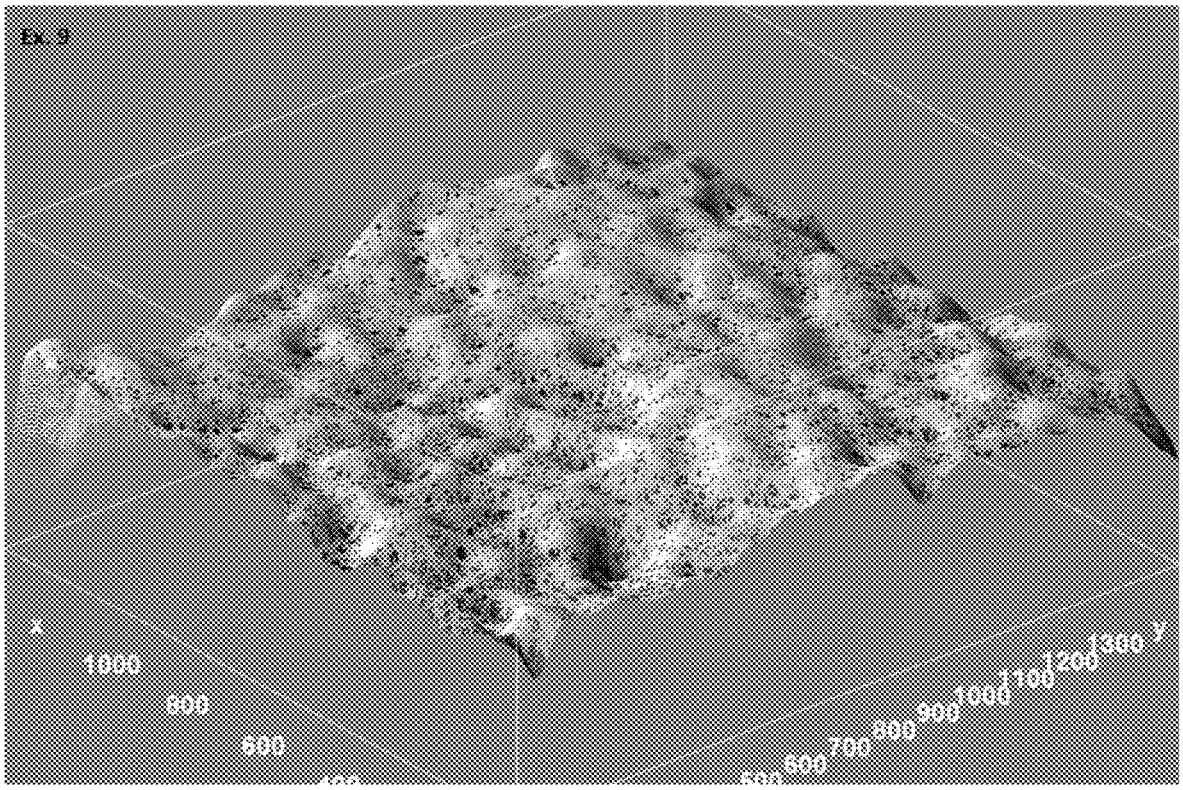
FIG. 17 depicts an image profiled to show the surface topography of the CT scanning microscopy image from FIG. 14 of a basesheet made using a split core press felt design according to the present disclosure (Ex. 10).
Figure 18:
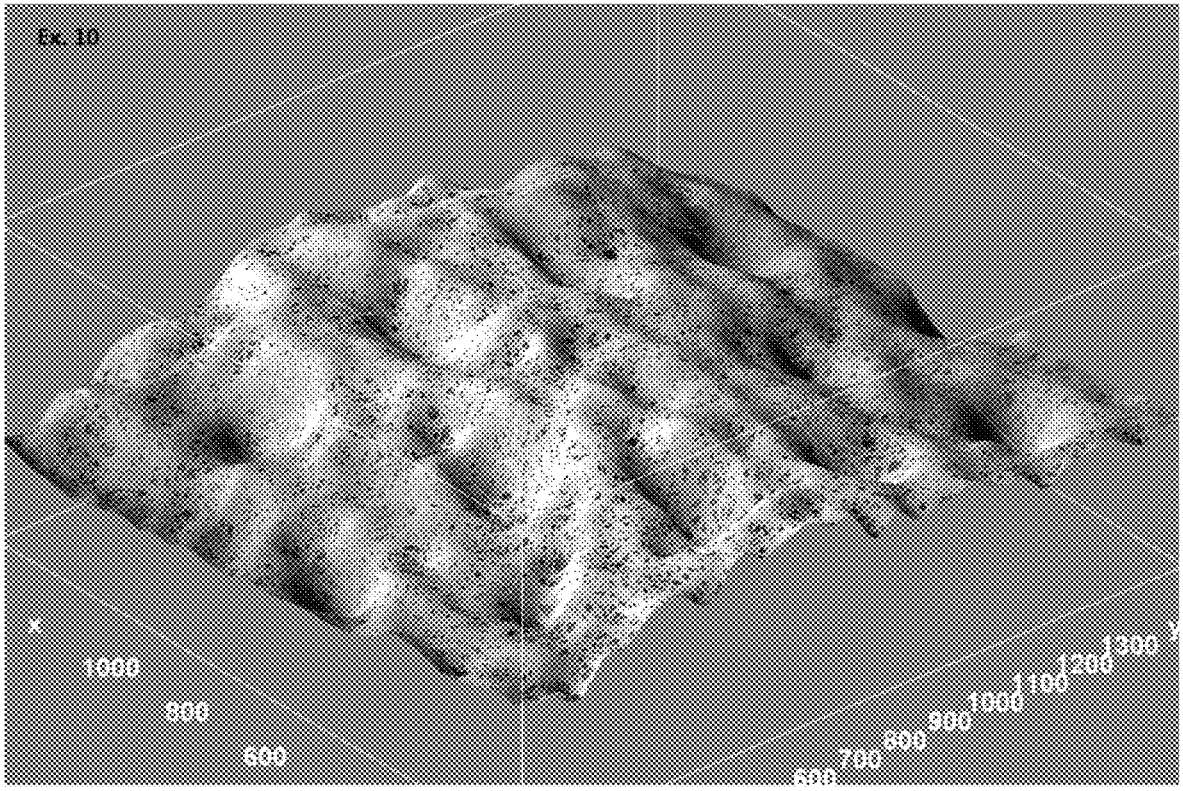
FIG. 18 depicts an image profiled to show the surface topography of the CT scanning microscopy image from FIG. 15 of a basesheet made using a press felt design with an apertured polymeric surface according to the present disclosure (Ex. 11).

Additional basesheets were formed on a pilot papermaking machine, comparing the surface of basesheets made with press felts Ex. 10 and Ex. 11 with the surface of a basesheet made with the control press felt. The results showed that there are areas of high and low density spots quite evident in the basesheets made with the inventive basesheets that show up as 3D structure-like airside domes. Surface images taken with CT scanning microscopy are shown in FIGS. 13-15 and images that were profiled to show surface topography in the CT scanning data are shown in FIGS. 16-18. The lighter areas in FIGS. 13-15 indicate areas of lower density, while the darker areas indicate areas of higher density. Thus, the basesheets made with each of the inventive press felts of Ex. 10 and Ex. 11 had increased areas of low density as compared to the basesheet made with the control press felt, with the basesheet made with press felt Ex. 11 exhibiting the greatest areas of low density.

It may be seen that employing a press felt with an apertured polymeric surface layer on the sheet side of the press felt, as in Ex. 11, may provide enhanced visual benefits to the underlying basesheet. Such an apertured polymeric surface layer could be beneficial in either a traditional press felt or a split base core press felt design.

Example 4

Properties of converted finished products made with the Control press felt were further compared with those made with the press felts of Ex. 10 and Ex. 11 at two different basis weights. The results are shown in Tables 2, 3, and 4 below. The finished product samples using the inventive press felts of Ex. 10 and Ex. 11 were made by the same processes as the control, respectively, except for the type of press felt used.

TABLE 2

| Felt Design | Basis Weight lb/3000 ft^2 | Caliper 8 Sheet (uncalendered) mils/8 sht | Caliper/BW |
|---|---|---|---|
| Control | 11.41 | 34.30 | 3.0064094 |
| Ex. 10 | 11.56 | 43.90 | 3.7972238 |
| Ex. 10 | 10.91 | 40.30 | 3.6928716 |
| Ex. 11 | 11.34 | 59.30 | 5.2310272 |
| Control | 9.85 | 34.83 | 3.5362221 |
| Ex. 10 | 9.13 | 32.68 | 3.5773796 |
| Ex. 10 | 8.67 | 31.10 | 3.5867475 |
| Ex. 11 | 9.47 | 43.05 | 4.5454119 |
| Ex. 11 | 9.40 | 46.48 | 4.9415467 |

As seen from Table 2 above, basesheets made with the inventive press felts designs of Ex. 10 and Ex. 11 each showed improved caliper per basis weight compared to basesheets made with the control press felt, particularly at higher basis weights. Table 2 also shows that the basis weight can be reduced while maintaining similar caliper to the control (see Ex. 10) or even higher caliper than the control (see Ex. 11).

TABLE 3

| Felt Design | Tensile MD g/3 in | Stretch MD % | Tensile CD g/3 in | Stretch CD % | Tensile Total Dry g/3 in | Tensile GM g/3 in | Tensile Dry Ratio Unitless | Break Modulus GM g/% |
|---|---|---|---|---|---|---|---|---|
| Control | 727 | 22.2 | 382 | 4.4 | 1110 | 527 | 1.90 | 51.98 |
| Ex. 10 | 791 | 25.0 | 433 | 5.1 | 1224 | 585 | 1.83 | 54.33 |
| Ex. 10 | 696 | 23.4 | 391 | 5.4 | 1087 | 522 | 1.78 | 47.94 |
| Ex. 11 | 722 | 26.7 | 386 | 5.7 | 1108 | 528 | 1.87 | 41.65 |
| Control | 783 | 22.6 | 407 | 5.1 | 1190 | 564 | 1.92 | 53.36 |
| Ex. 10 | 725 | 19.0 | 362 | 5.0 | 1087 | 512 | 2.00 | 52.73 |
| Ex. 10 | 765 | 20.2 | 331 | 4.5 | 1096 | 503 | 2.31 | 55.53 |
| Ex. 11 | 838 | 24.8 | 414 | 5.2 | 1252 | 589 | 1252 | 54.42 |
| Ex. 11 | 665 | 25.8 | 371 | 6.0 | 1036 | 497 | 1.79 | 40.88 |

TABLE 4

| Felt Design | Tensile GM g/3 in | Softness |
|---|---|---|
| Control | 527 | 18.5 |
| Ex. 10 | 585 | 18.5 |
| Ex. 11 | 528 | 18.8 |

A number of embodiments have been described herein. Nevertheless, it will be understood that various modifications may be made without departing from the spirit and scope of the disclosure. Accordingly, other embodiments are within the scope of the following claims.

We claim:

1. A press felt comprising:

a sheet-side and a roll-side;

a first base core material comprising a woven yarn;

a second base core material comprising a woven yarn; and a fibrous batting material located between the first base core material and the second base core material, wherein the fibrous batting material located between the first base core material and the second base core material comprises two layers, and wherein the layer of fibrous batting material located closer to the first base core material is coarser than the layer of fibrous batting material located closer to the second base core material.

2. The press felt of claim 1, wherein the second base core material is located closer to the sheet-side of the press felt than the first base core material.

3. The press felt of claim 2, wherein the press felt further comprises a fibrous batting material on the sheet-side of the second base core material and/or a fibrous batting material on the roll-side of the first base core material.

4. The press felt of claim 2, further comprising a third base core material comprising a woven yarn located closer to the sheet-side of the press felt than the second base core material, and comprising a fibrous batting material on the sheet-side of the second base core material and between the second base core material and the third base core material.

5. The press felt of claim 1, wherein the woven yarn of the first base core material and the woven yarn of the second base core material are selected from the group consisting of: natural yarns, synthetic yarns, monofilament yarns, multifilament yarns, hollow yarns, coarse yarns, smooth yarns, and combinations thereof.

6. The press felt of claim 1, wherein the woven yarn of the first base core material and the woven yarn of the second base core material have a cross-sectional shape selected from the group consisting of: round, flat, and combinations thereof.

7. The press felt of claim 6, wherein the cross-sectional shape is selected from the group consisting of: circular, oval, elliptical, and rectangular.

8. The press felt of claim 1, wherein the woven yarn of the first base core material and the woven yarn of the second base core material are selected from the group consisting of: cross-machine-direction oriented ("CD") yarns, machine-direction oriented ("MD") yarns, both CD yarns and MD yarns, and CD yarns woven together with MD yarns to form a woven layer.

9. The press felt of claim 1, wherein the first base core material and/or the second base core material comprises fibrous batting entangled therethrough.

10. The press felt of claim 1, wherein the yarn of the second base core material is coarser than the yarn of the first base core material.

11. The press felt of claim 1, wherein the first base core material comprises two woven layers of yarn, each layer comprising cross-machine-direction oriented yarns that are woven together with machine-direction oriented yarns.

12. The press felt of claim 3, wherein both layers of the fibrous batting material located between the first base core material and the second base core material are coarser than the fibrous batting material located on the sheet-side of the second base core material.

13. The press felt of claim 1, wherein the fibrous batting material is nylon or wool.

14. The press felt of claim 1, wherein the fibrous batting material located between the first base core material and the second base core material comprises at least 10% of the thickness of the entire press felt.

15. The press felt of claim 1, wherein the fibrous batting material, the first base core material, and the second base core material are connected to each other by one or more of stitching, needling, or an adhesive.

16. The press felt of claim 1, wherein the press felt further comprises a polymeric laminate, film, or foam layer.

17. The press felt of claim 1, wherein the press felt further comprises an apertured polymeric layer.

18. The press felt of claim 12, wherein both layers of the fibrous batting material located between the first base core material and the second base core material have fiber diameters larger than the fiber diameters of the fibrous batting material located on the sheet-side of the second base core material.

19. The press felt of claim 1, wherein the layer of fibrous batting material located closer to the first base core material has fiber diameters larger than the fiber diameters of the layer of fibrous batting material located closer to the second base core material.

20. The press felt of claim 10, wherein the yarn of the second base core material has a diameter larger than the yarn diameter of the first base core material.

21. A press felt comprising:

a sheet-side and a roll-side, at least one base core material comprising a woven yarn, and at least one fibrous batting material located on the sheet-side of the press felt, wherein the fibrous batting material comprises an apertured polymeric sheet-side surface located at the sheet-side surface of the press felt.

22. The press felt of claim 21, wherein the base core material is surrounded by a roll-side fibrous batting material and the sheet-side fibrous batting material with an apertured polymeric sheet-side surface.

* * * * *